United States Patent [19]

Williams

[11] Patent Number: 4,526,430

[45] Date of Patent: Jul. 2, 1985

[54] MARINE SEISMIC CABLE CONNECTOR

[75] Inventor: Shandton D. Williams, Houston, Tex.

[73] Assignee: Litton Research Systems, Inc., Alvin, Tex.

[21] Appl. No.: 551,164

[22] Filed: Nov. 14, 1983

[51] Int. Cl.[3] ..... H01R 13/629; H01R 25/00; H01R 13/58

[52] U.S. Cl. ..... 339/45 M; 339/49 R; 339/94 M; 339/104

[58] Field of Search ..... 339/45 R, 45 M, 47 R, 339/48, 49 R, 49 B, 94 R, 94 M, 103 R, 103 M, 104; 367/15, 20, 154, 177; 174/101.5

[56] References Cited

U.S. PATENT DOCUMENTS 2,825,039 2/1958 Schurman et al. ..... 174/101.5 X 3,812,455 5/1974 Pearson ..... 340/7 R 4,204,188 5/1980 Weichart et al. ..... 367/154

4,249,788 2/1981 McNeel ..... 339/49 R X 4,260,211 4/1981 Mollere ..... 339/91 B

*Primary Examiner*—Gil Weidenfeld

*Assistant Examiner*—Steven C. Bishop

*Attorney, Agent, or Firm*—William A. Knox

[57] ABSTRACT

A hermaphroditic connector-half for coupling together adjacent streamer-cable sections consisting of an outer plastic shell that can be slid over a stress plate that carries a plurality of multicontact connector plugs. For maintenance purposes, the outer shell can be removed so that free access may be had to the contacts of the connector plugs and to the multiple conductors in the streamer cable.

5 Claims, 6 Drawing Figures

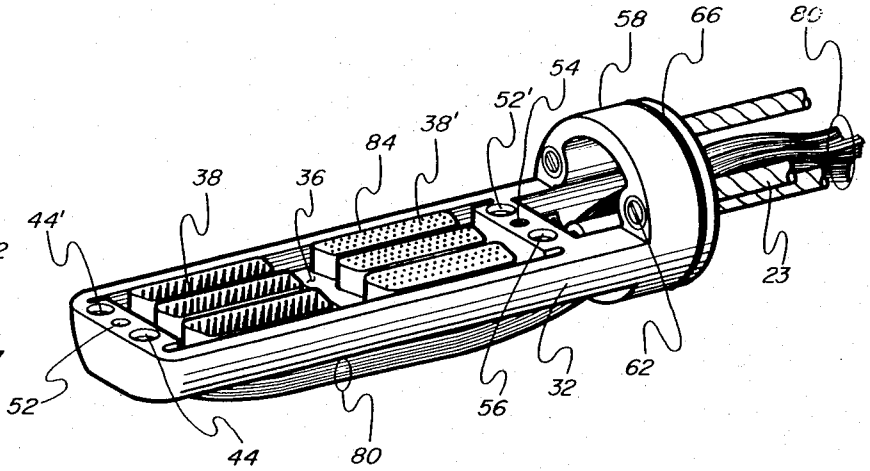
FIGURE 4
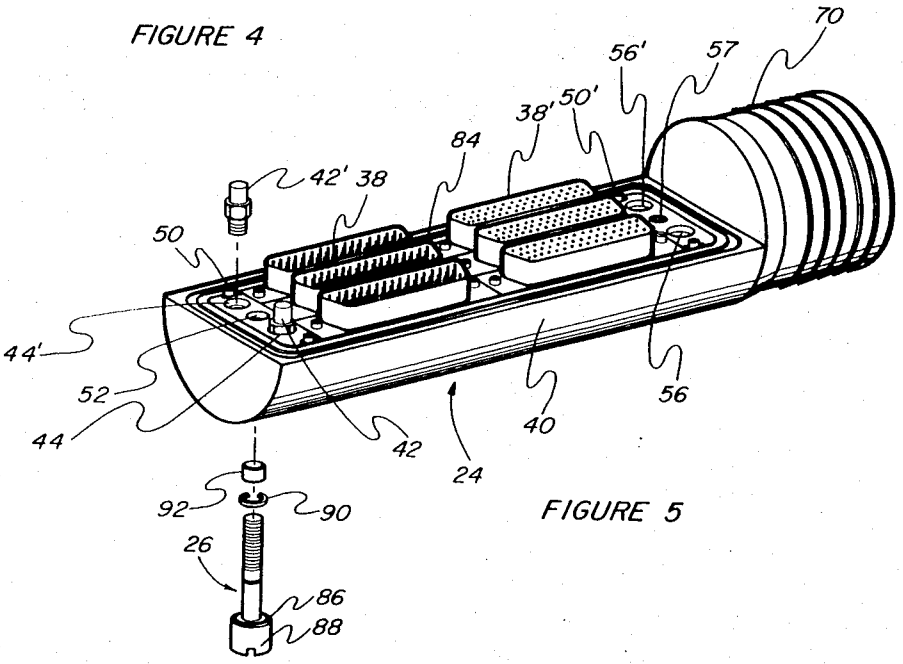
FIGURE 5
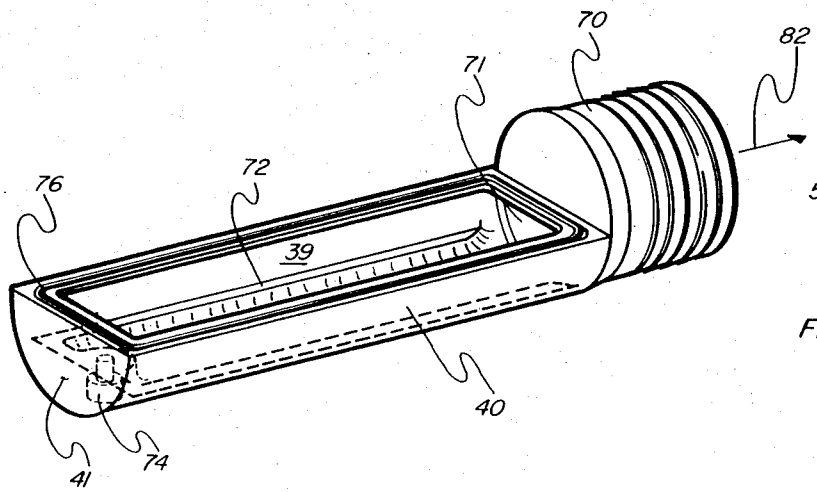

MARINE SEISMIC CABLE CONNECTOR

BACKGROUND OF THE INVENTION

1. Field of the Invention

This invention is concerned with waterproof, multicontact electrical connectors for interconnecting, mechanically and electrically, the respective sections of a seismic streamer cable.

2. Discussion of the Prior Art

A typical seismic streamer cable used for geophysical exploration in a marine environment consists of up to fifty individual sections, each about 200 to 300 feet long. Each section consists of a cylindrical plastic jacket that encloses a plurality of hydrophones and other sensors. The electrical output signals from the sensors are transmitted to signal utilization equipment aboard a mother ship through electrical conductors. There may be several hundred such conductors. One or more stress members, usually of steel, are threaded through the jacket to take up towing stress. The jacket is filled with a buoyant fluid so that the entire assembly is neutrally buoyant in the water.

In use, the mother ship tows the streamer cable through the water at about four to six knots. Periodically a sound source is fired to generate sound waves which are reflected from sub-bottom earth layers. The reflected sound waves are detected by the hydrophones whose output signals are processed by the signal utilization device.

Suitable cable-section connectors are required to have a number of attributes. Of course, they must be waterproof. They must be able to accommodate at least two to three hundred or more wires yet remain of a seasonable physical size so that the connector will not generate noise due to towing turbulance. When under tow, the connectors must survive a mechanical tensional load in excess of 14000 pounds.

For maintenance purposes, the mating halves of a connector must be easily mated or demated. Because of the large number of individual electrical contacts, the mating/demating force may be in excess of 200 pounds. Therefore means must be provided to separate or connect a pair of mating connnectors without undue strain on the part of the operator in the field or damage to the connector plug housings.

There are a number of marine seismic cable connectors commercially available. Typical of such connectors are those disclosed in U.S. Pat. No. 3,812,455 issued May 21, 1974 to Ray Pearson and U.S. Pat. No. 4,204,188 issued May 20, 1980 to Helmut Weichart et al. A somewhat different type of connector is disclosed in U.S. Pat. No. 4,260,211, issued Apr. 7, 1981 to John Mollere.

It is a purpose of this invention to provide a seismic marine cable connector that creates a minimal amount of turbulent noise under tow, that has the mechanical strength to withstand not only steady-state towing tension but jerk forces as well. The connector must be of simple construction; it must be easy to asssemble and disassembled in the field for maintenance purposes.

SUMMARY OF THE INVENTION

In accordance with this invention, I provide a marine streamer-cable section having an outer jacket, a plurality of seismic sensors, a plurality of electrical conductors for transmitting seismic signals from the sensors, at least one stress member and an identical connector half at each end of the section. Each connector half includes an internal stress plate having an upper and lower surface with at least one shear lug mounted on the upper surface. A plurality of multicontact contact plugs are mounted on the upper surface of the stress plate. The contact plugs of one connector are mateable with contact plugs mounted on the stress plate of a connector half of an adjacent cable section. The stress plate and items secured thereto are enclosed in a removable hemispherical plastic shell.

In accordance with another aspect of this invention, means are provided to seal a pair of connector halves from fluid invasion when said halves are mated.

In accordance with another aspect of this invention, a pair of connector halves are engaged and disengaged by means of jack screws.

In accordance with yet another aspect of this invention, the contact plugs are mounted to the stress plate over riser bars. When the riser bars are removed, the contact plugs and stress plate can be retracted with respect to the outer plastic shell so that the stress plate can be removed from within the shell to provide free access to wire connections to the contacts.

BRIEF DESCRIPTION OF THE DRAWINGS

The beneficial features and advantages of this invention will best be understood by reference to the appended detailed description and the drawings wherein:

FIGS. 4 and 5 show the method of assembling a connector assembly;

DETAILED DESCRIPTION OF THE PREFERRED EMBODIMENT

Figure 1:
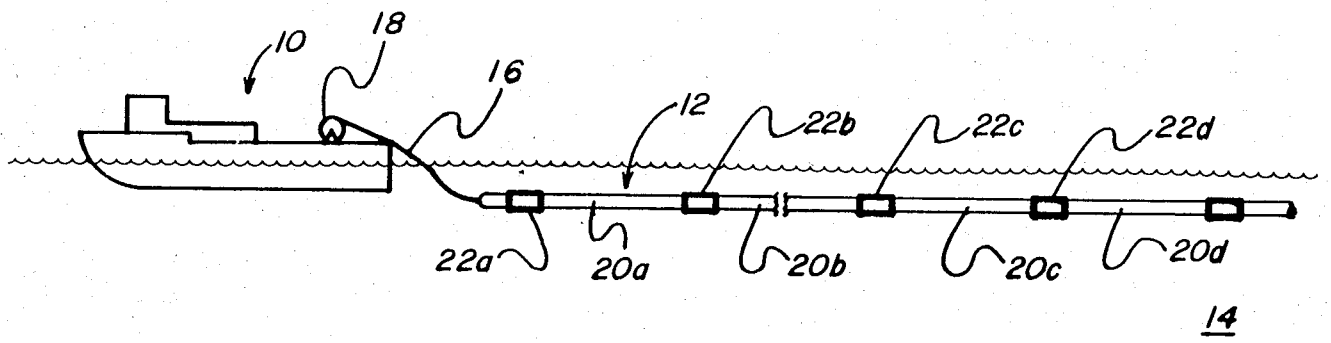
FIG. 1 is illustrative of a typical ship-towed seismic streamer cable.
Figure 2:
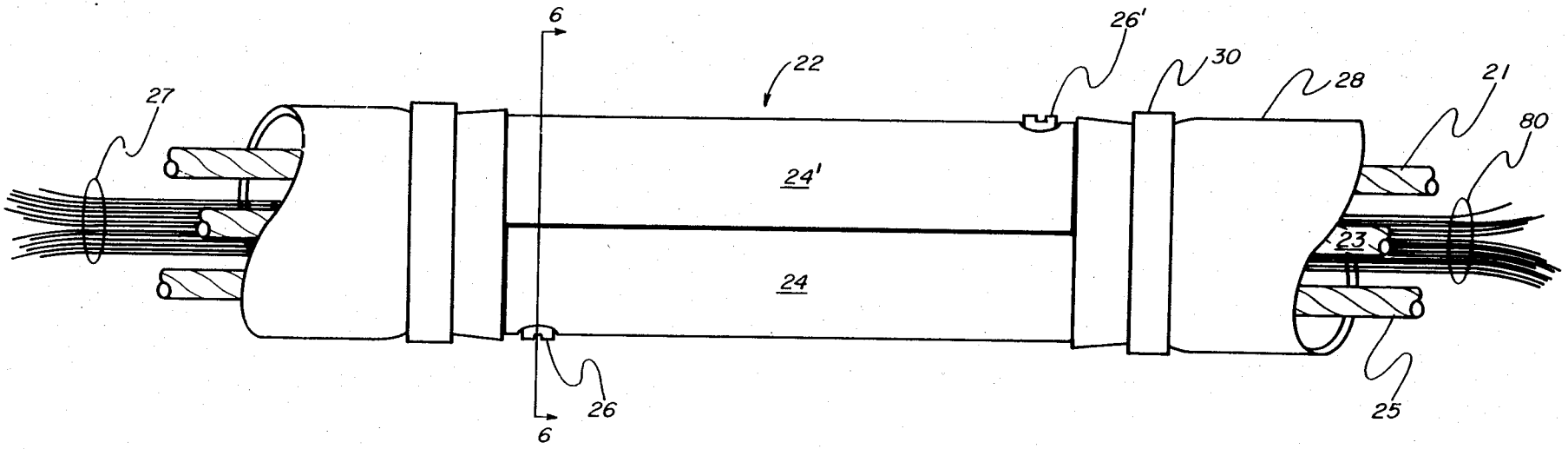
FIG. 2 is an overall view of a pair of connectors for joining adjacent cable sections.

Referring now to FIGS. 1 and 2, a ship 10 tows a seismic streamer cable 12 through a body of water 14 by a lead-in cable 16 that is secured to a towing and storage reel 18 on the ship. The streamer cable 12 consists of a plurality of separate sections 20*a–d* that are coupled together by the cable connectors 22*a–d* of this invention. Only four sections are shown but many more are used in practice. Each section, consists of a plastic jacket 28 (FIG. 2) within which are carried a bundle of well known conductors 27, hydrophones (not shown), and stress members such as 21, 23, 25. Each section is filled with a buoyant liquid so that it will be neutrally buoyant.

Identical cable-connector half housings (or simply "connectors" for brevity) are installed on the ends of each section as shown in FIG. 2. The connectors are preferably hermaphroditic so that the connector 24 on one end of a first section will mate with an identical connector 24' on the end of a second adjacent section as shown in FIG. 2. A single floating jack screw 26, mounted on the free end of connector 24, screws into a threaded socket of connector 24'; similarly a single floating jack screw 26' mounted in the free end of connector 24', screws into a threaded socket in the opposite connector 24. The jack screws not only serve to hold the two connectors firmly together when in use, they also serve to pry the two connectors apart for maintenance service as will be seen later. In use, the open end of a jacket 28 of each cable section is secured to the fixed end of the corresponding connector such as 24 by one or more suitable steel bands such as 30, well known to the art.

Figure 3:
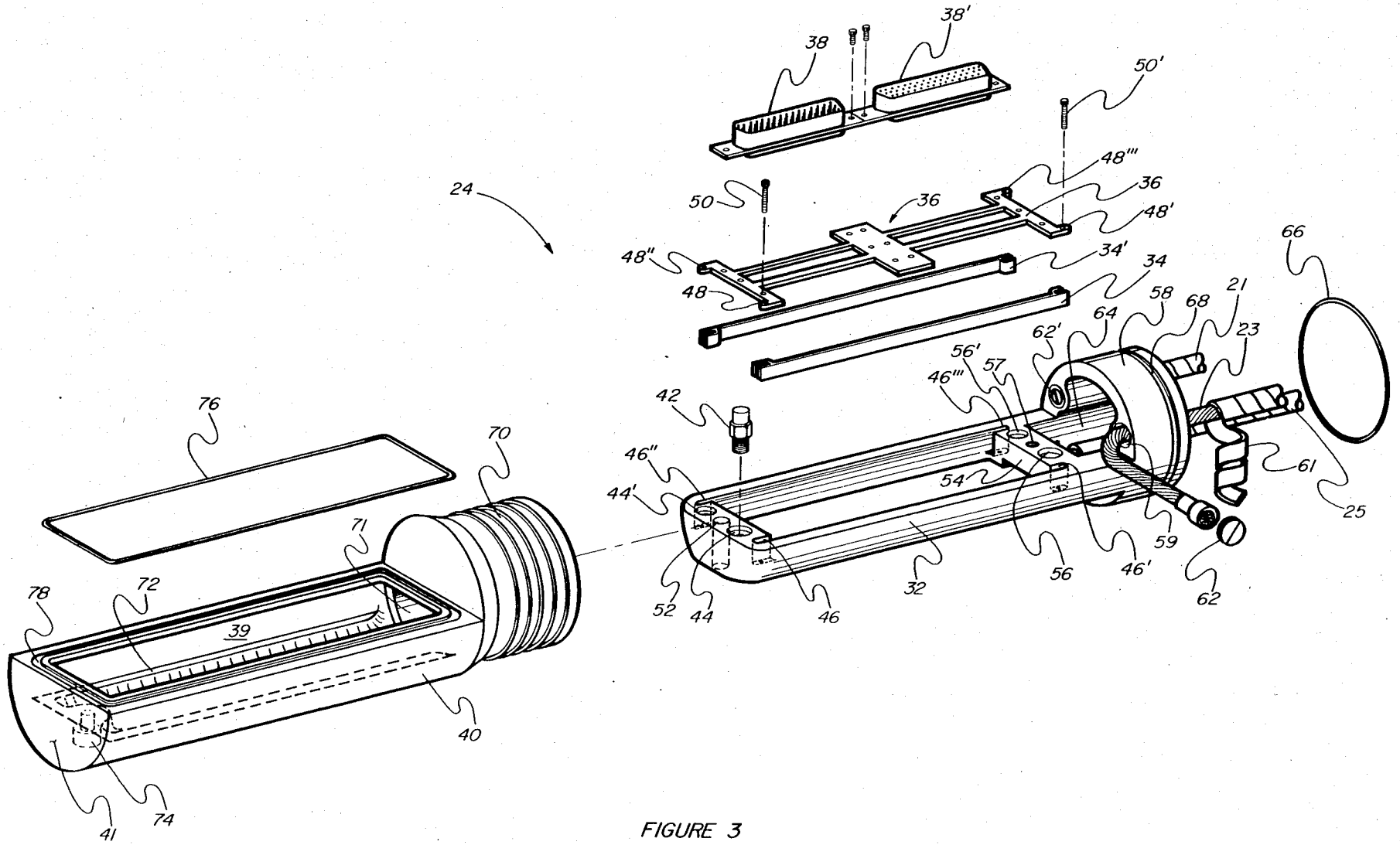
FIG. 3 is an exploded view of a connector assembly.

FIG. 3 is an exploded view of a typical connector-half such as 24. Since the connectors are all identical, a description of one connector is sufficient.

The essential mechanical parts of connector 24 are: stress plate 32 having free and fixed ends, riser bars 34, 34', connector plate 36 upon which may be bolted a plurality of miniature commercially-obtainable multi-contact plugs (50 contacts are typical) such as 38, 38', and plastic shell or cover 40. A shear lug such as 42, threaded on its lower end, smooth on its upper end and provided with wrench-receiving flats at its center portion, may be removably screwed into a threaded socket 44 at the free end of stress plate 32. A second shear plug, not shown, is screwed into threaded socket 44' on the other side of stress plate 32.

Stress plate 32 preferably may be a casting of titanium, aluminum or stainless steel, having recesses 46–46''' for receiving riser bars 34, 34' and the ears 48–48''' at the four corners of connector plate 36. Suitable screws, such as 50, 50', secure connector plate 36 to stress plate 32 on top of riser bars 34, 34'. A bore 52 is provided at the center of the free end of the stresss plate to receive a jack screw 26 to be discussed later. A bridge 54 is provided near the fixed end of the stress plate 32. Bridge 54 includes two smooth sockets 56, 56' to receive the smooth end of the shear lugs from an opposite connector half. When two connectors are mated, the shear lugs transfer the towing stress from the stress plate of one connector to the stress plate of a mating connector. Threaded socket 57 receives a jack screw from an opposite connector plug such as 24', FIG. 2.

A hollow enlarged cylindrical portion 58 is formed at the fixed end of stress plate 32. The cylindrical portion has several apertures such as 59 to receive and anchor the ends of the streamer-section stress members such as 23. Generally, an aircraft-type anchor is swaged to the end of the stress member and is seated inside aperture 59 where it is held in place by threaded caps such as 62, 62'. The stress members may be wrapped with plastic tape 61 if desired. An electrical conductor bundle 80 not shown in FIG. 3, is admitted through the bottom of a hollow portion 64 of cylindrical portion 58 where they may be potted in place by a suitable compound such as epoxy resin. O-ring 66 fits into a groove 68 of cylindrical portion 58.

Plastic shell 40 is characterized by an elongated semicylindrical body that defines an internal semicylindrical cavity 39. The free end 41 is closed; the fixed end is characterized by a hollow, short, partially-closed cylindrical portion 70 having a lower opening 71. A part of the outer surface of cylindrical portion 70 is serrated to receive and grip the open end of the plastic cable jacket 28 of a cable section as shown in FIG. 2.

Shell 40 is designed to slide over stress plate assembly 32. A water-tight seal is formed between the outer wall of cylindrical portion 58 and the inner wall of cylindrical portion 70 of stress plate 32 and shell 40 respectively by O-ring 66 when the O-ring is seated in groove 68. A ledge 72 inside shell 40 receives the underside of stress plate 32. A countersunk bore 74 that may be aligned with bore 52 when the connector parts are assembled is provided for the purpose of receiving a jack screw. A rectangular quasi-O-ring 76 fits into a corresponding slot 78 in the upper surface of shell 40 around the semicylindrical cavity 39. When two mating connectors are pressed together, the rectangular quasi-O-ring provides a water-tight seal.

FIGS. 4 and 5 demonstrate the method of assembly of a connector 24. Connector plate 36 is mounted within stress plate 32. Multicontact plugs 38 and 38', plus a plurality of additional plugs as shown, are bolted to connector plate 36 by known techniques. Thereafter the respective ones of a plurality of conductors 80 are soldered to the solder lugs on the bottom side (not shown) of the plugs in a manner well known to the art. It should be observed that, at this point, the wires and solder lugs are freely and conveniently accessible for servicing. Connector plate 36 is placed inside stress plate 32 with ears 48–48''' mating with recesses 46–46'''. However, riser bars 34, 34' are *not* yet put in place under connector plate 36. Therefore connector plate 36 and the contact plugs that it supports may be retracted with respect to the top of the stress plate so that the tops of the contact-plug bodies are flush with the top 84 of stress plate 32. Now, plastic shell 40 slides into place around stress plate 32 as shown by arrow 82 until the enlarged portion 70 of shell 40 makes contact with and overlaps O-ring 66 on the enlarged cylindrical portion 58 of the stress plate.

When the stress plate assembly is in place within the cavity 39 in the shell, contact plate 36 is raised slightly above the top surface 84 of stress plate 32. The riser bars 34 and 34' are positioned beneath contact plate 36 into recesses 46–46'''. The contact plate is returned to place above the riser bars and is bolted into place by bolts such as 50, 50' through bolt holes in ears 48–48''' as shown in FIG. 5. The contact plugs are now in an extended position with their tops jutting above top surface 84 of stress plate 36, supported by the removable riser bars, and configured to mate with the corresponding plugs from an opposite connector such as 24'. After the plugs are mounted in place, removable shear lugs 42, 42' are securely screwed into threaded sockets 44 and 44'. Finally a jack screw 26 is inserted through hole 74 in shell 40, and bore 52 of stress plate 32. Jack screw 26 includes a sealing O-ring 86 that is countersunk into a groove beneath the head 88 of jack-screw 26. After the jack screw has been inserted, it is floatingly held in place by placing a snap ring 90 is a groove around the shank of the screw, just below the screw threads. A bushing 92 may then be screwed on top of the snap ring. For simplicity of the drawing, O-ring 76 is not shown in FIG. 5.

In use, two oppositely oriented connectors, such as 24 and 24' are pressed together so that the male and female contact plugs are engaged. The shear lugs screwed in to the free end of one plug, fit into the sockets such as 56 and 56' of the other plug. The jack screw of one plug may then be screwed into the threaded socket such as 57 of the other plug, holding the two plugs tightly together to make a water-tight connection.

Figure 6:
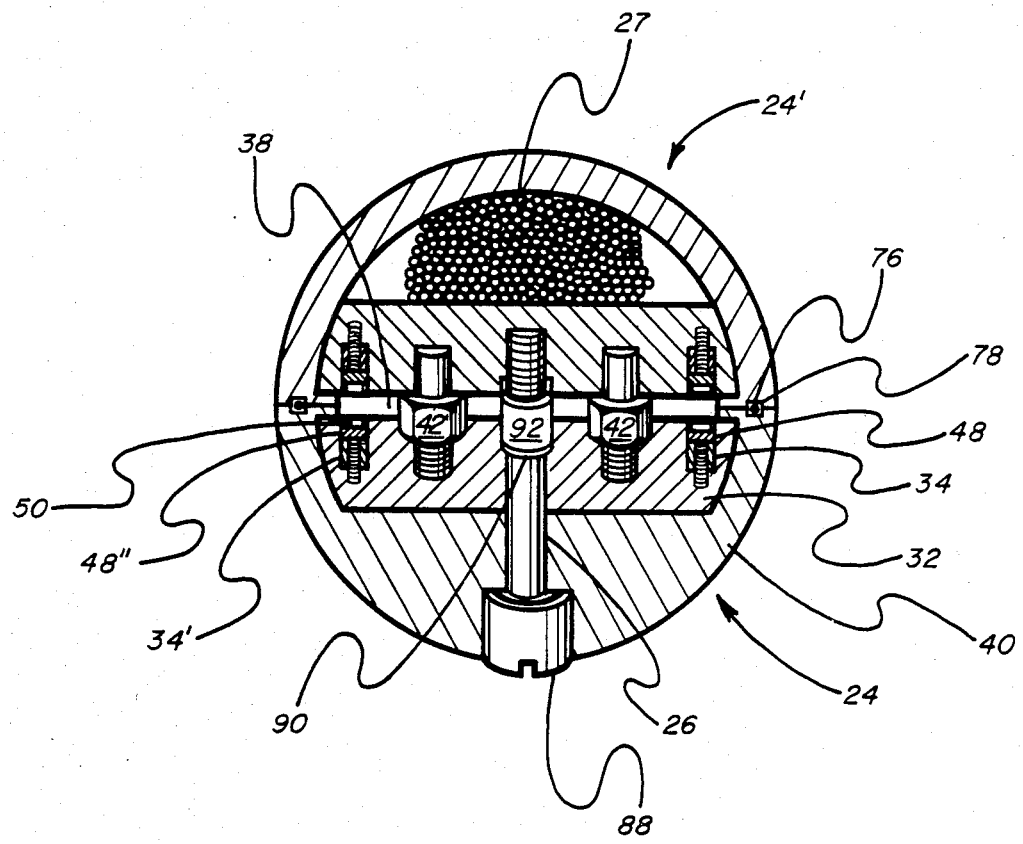
FIG. 6 is a cross section along line 6—6 of FIG. 2.

FIG. 6 is a cross section along line 6—6 of FIG. 2, showing the two connectors 24 and 24' mated together. The cross section illustrates the positioning of the riser bars 34, 34' beneath the ears 48, 48''. Further illustrated is the method of engagement of the jack screw 26 and shear lugs 42, 42' of connector half 24 with a mating connector half 24'. It should be noted that although the connector halves are otherwise identical, they share but a single quasi-O-ring 76 between themselves. In FIG. 6, conductor bundle 27 enters connector half 24' from the left while conductor bundle 80 is of course hidden from view in the Figure.

An important feature of this invention is the capability of disassembly of two mating connectors. As earlier pointed out, considerable force is required to pry apart the contacts of the plurality of contact plugs. As will be recalled, a snap ring 90 holds the jack screws floatingly in place. When the jack screws of mating connectors are backed off, the screws perforce remain in place because of the snap rings and hence necessarily force apart the respective connectors such as 24 and 24' against the resistance of the plug contacts.

Another advantage of the preferred design is the fact that towing stresses are taken up by the stress plates. Stress transfer between a pair of stress plates is taken up by the shear lugs rather than by the jack screws or other type of connector coupling bolts. Accordingly, only two such screws are required.

A third advantage lies in the area of field maintenance. If broken wires need to be repaired or a contact plug replaced, it is a simple matter to remove the watertight plastic shell 40. Thereby free access may be had to all of the wires and plugs.

And finally the connector is compact, no larger in diameter than the cable section, it is light because of the use of a plastic case, and any number of conductors may be accommodated merely by lengthening the unit to accept a third or fourth rank of contact plugs.

I claim:

1. An improved waterproof connector having a free end and a fixed end for electrically and mechanically coupling together adjacent marine streamer-cable sections, each said section including a tubular plastic outer jacket, secured to the fixed end of the connector, that contains a plurality of sensors, a plurality of electrical conductors for transmitting sensor signals, at least one stress member, the jacket further including a volume of buoyant liquid therein, the connector comprising:

a semicylindrical outer shell that defines an elongated semicylindrical cavity closed at the free end, the shell including a hollow partially closed cylindrical portion at the fixed end abutting said cavity;

a stress plate assembly having fixed and free ends, the assembly including a retractably extendable connector plate upon which are mounted a plurality of multiple contact plugs to which said conductors are connected, said connector plate having a retracted position and an extended position within said stress plate, the plugs being arranged in hermaphroditic configuration, the stress plate being slidably mounted within the cavity of said outer shell;

a floatingly mounted jack screw inserted through the free end of said connector for forcibly-disengagingly engaging a mating connector from an adjacent cable section;

at least one shear lug removably mounted at the free end of the stress plate of a first connector, mateable with a socket at the fixed end of a stress plate of a mating connector, for transferring stresses from the stress plate of said first connector to the stress plate of a second mating connector of an adjacent cable section; and a removable riser bar mountable beneath each side of said connector plate for supporting said connector plate in the extended position.

2. The connector as defined by claim 1, further comprising:

means for retracting said connector plate and said multiple contact plugs within said stress plate to allow said stress plate assembly to be removed from said outer shell.

3. The connector as defined by claim 2, further comprising:

an enlarged cylindrical portion at the fixed end of said stress plate;

an O-ring encircling said enlarged cylindrical portion of the stress plate for sealingly-interiorly engaging the hollow partially-closed cylindrical portion of said shell;

at least one socket in the cylindrical portion of said stress plate for anchoring said at least one stress member; and an opening in said cylindrical portion of said stress plate for receiving therethrough a plurality of conductors from said cable section.

4. The connector as defined by claim 3, further comprising:

a groove around said semicylindrical cavity for receiving a quasi-O-ring to provide a watertight seal between two mating connectors of adjacent cable sections.

5. The connector as defined by claim 4, further comprising:

a ledge on opposite sides of said elongated semicylindrical cavity of said shell for supporting said stress plate assembly.

* * * * *

UNITED STATES PATENT AND TRADEMARK OFFICE

CERTIFICATE OF CORRECTION

PATENT NO. : 4,526,430

DATED : July 2, 1985

INVENTOR(S) : Shandton D. Williams

It is certified that error appears in the above-identified patent and that said Letters Patent are hereby corrected as shown below:

On the title page;

The assignee should read:

Litton Resources Systems, Inc.

Signed and Sealed this

*Fifteenth* Day of *October 1985*

[SEAL]

*Attest:*

*Attesting Officer*

DONALD J. QUIGG

*Commissioner of Patents and Trademarks—Designate*